United States Patent [19]

Steinke

[11] 4,324,506

[45] Apr. 13, 1982

[54] SELF-REGULATING FLUID CONTROL VALVES

[76] Inventor: Thomas J. Steinke, 1673 Melville Ave., Fairfield, Conn. 06430

[21] Appl. No.: 182,129

[22] Filed: Aug. 28, 1980

[51] Int. Cl.[3] ..... F02B 7/40

[52] U.S. Cl. ..... 405/96; 137/217; 137/218; 137/423; 137/488; 405/101; 405/127

[58] Field of Search ..... 405/96, 101, 127; 137/217, 218, 236, 388, 423, 488

[56] References Cited

U.S. PATENT DOCUMENTS

| | | | |
|---|---|---|---|
| 1,354,879 | 10/1920 | Boland | 137/448 X |
| 1,832,243 | 11/1931 | Ritchie | 137/448 |
| 1,861,397 | 5/1932 | Khun | 137/448 X |
| 3,166,083 | 1/1965 | Girden | 137/388 |
| 4,091,624 | 5/1978 | Steinke | 405/96 |

*Primary Examiner*—Harold W. Weakley
*Attorney, Agent, or Firm*—Cifelli, Frederick & Tully

[57] ABSTRACT

A self-regulating tide gate is installed on a conduit connecting an open body of water with a protected body of water. The tide gate comprises a mounting plate secured to the conduit at its end in the open body of water, the mounting plate defining an opening into the conduit. A door has its upper edge pivotally mounted at the top of the conduit, a door float is mounted to the door on its edge opposite the hinged edge and counterfloats are mounted to counterfloat arms extending from the door across the pivot axis thereof. When the water is below a critical level at which it is desired that the door close, the door float maintains the lower edge of the door on the surface of the water, thereby maintaining the door open and blocking debris from jamming the mouth of the conduit. As the water level rises, it acts on the counterfloat to pivot the door towards its closed position, whereafter the door is caught in the flow of water entering the conduit and rapidly pivoted to its closed position. The counterfloats are attached to the counterfloat arms by links, the length of which is selected to achieve closure of the door at the desired critical level. A vacuum break conduit comprises an air pipe intersecting the conduit adjacent the mounting plate for the door, the air pipe extending above the critical water level. A lid is provided on the open end of the air pipe and a counterweighted float maintains the lid open until water rises to near the open end of the conduit whereafter the counterweighted float closes the lid to block the air pipe. The air pipe is open when the door closes, and permits air to enter the conduit immediately behind the door to reduce the pressure differential across the door immediately after it closes.

18 Claims, 6 Drawing Figures

SELF-REGULATING FLUID CONTROL VALVES

BACKGROUND OF THE INVENTION

This invention relates to the improved self-regulating fluid control valves, and more particularly to a self-regulating tide gate which permits reciprocal flow through a conduit connecting two bodies of water but closes to cut off such flow upon conditions which would result in an undesirably high water level in a protected one of the bodies of water.

For centuries man has tried to prevent river and tidal flooding of improved property by erecting dikes. Cross culverts or conduits are generally provided through the dikes, and one-way flap valves are installed on the conduits on the unprotected or water side of the dike to prevent interior flooding. More particularly, the one-way flap valve allows the passage of upland runoff water through the conduit, such water pushing open the one-way, top-hinged flap valve when the hydraulic head of the upland water exceeds that of the outer flood waters. As the water levels from river, estuary or ocean periodically rise, especially toward a flood level, the outer hydraulic head on the flap valve exceeds that of the interior upland water in the conduit, thereby forcing the freely pivoting top-hinged flap valve against the conduit mouth to prevent any reverse flow of water to the interior, protected area. Worldwide, this approach has been used to protect many millions of dollars of agricultural, commercial, residential, and industrial properties. But while the basic goal of flood damage protection has been achieved, the conventional one-way flap valve causes many other equally significant problems.

In tidal marsh areas adjacent to upland protected property, flood dike cross-culverts which are fitted with one-way valves exclude salt water and potential tidal ocean flooding while permitting drainage of upland runoff at low tide. But the exclusion of tidal scour and salt water also eliminates their sediment transport functions and the animal and plant life dependent upon them. Man-made and natural drainage channels fill with sediment thereby inhibiting the drainage of upland runoff which results in the increased flooding of upland storm sewers and low-lying yards and streets. As slit and debris fill in the old channels there is a concomitant increase in isolated pools of water which multiply mosquito breeding since the natural fish predators of mosquitos have been excluded with the tide. Because tidal waters are excluded, the interior water changes from salt water to fresh water, which results in the loss of salt water plants and the introduction of vigorous fresh water species such as the tall reed grass, phragmites. Phragmites grass supports artificially high tick and mosquito populations during its summer growing season and in the winter and spring its dry stems represent a severe fire and smoke hazard to improved property. Isolation of the marsh from the sea eliminates clams, shrimp, oysters, mussels and crabs. Marsh isolation eliminates all marsh-dependent fish which rely on it for breeding, nursery or feeding activities. This loss of nutrient-rich water of the healthy salt marsh short-circuits the ecological food chain to the ocean by removing its base of production. This damage to both marsh and ocean resource productivity imposes far-reaching losses to commercial and recreational fish and shellfish harvests. All of these problems can be significantly reduced or eliminated by allowing controlled salt water flushing of the marsh on the protected side of the dike if accompanied by protection against flooding improved property.

Until recently, salt water flushing without flooding has required either: (1) manually closing and opening of the simple one-way flap valve attached to a dike/conduit system during the critical discharge period before and after every storm with a flooding potential, or (2) automatic operation of relatively complex gate systems using electrical or mechanical means based on power sources external to the gate installation. Either mode of operation requires significant investment to acquire, install, operate and maintain the gate system.

In an effort to provide reciprocal water flow without flooding, Mirto U.S. Pat. No. 3,974,654 disclosed an inclined-mouth, bottom hinged, non-buoyant, float-operated valve. In operation, this valve would damage its bulkhead-dike installation and self-destruct because it failed to correctly address the need for vacuum dissipation after valve closure and thereby created more of a flooding problem than it solved. It was also unreliable in operation even prior to self-destruction.

Conventional flap valves allowing one-way flow are rarely kept in an open position because they cannot be safely closed after a significant current of water has begun to pass the valve. This is because the valve and conduit were not designed to sustain the significant forces resulting upon closure in high flow conditions, including forces due to the weight of the valve, the approach column of water abruptly stopping as it rams the face of the valve, and from the suction or vacuum pressure of the entire column of conduit water which is still moving away from the valve after it has closed.

The prior art has but one instance where reciprocal flushing without flooding has been achieved successfully, namely Steinke U.S. Pat. No. 4,091,624. The Steinke '624 patent has several gate designs all of which incorporate a vertical tube or vacuum break which dissipates the vacuum created in the cross-culvert following gate closure. However, all of the Steinke '624 patent's gate and vacuum break design are either of relatively complicated design or expensive to manufacture. Further, both Steinke's and Mirto's gates, being designed to be either fully open or fully closed, are somewhat susceptible to jamming and obstruction by ice and debris when the gate is open allowing objects to enter the mouth of the conduit.

SUMMARY OF THE INVENTION

A self-regulating fluid control valve or tide gate, according to the invention herein provides reciprocal flow in a conduit connecting a protected body of water and an open body of water. The self-regulating tide gate automatically closes upon the attainment of predetermined critical water level in the open body of water, whereby further flow of water into the protected body of water is blocked to prevent flooding. The self-regulating tide gate automatically restores reciprocal flow when the water level in the unprotected body of water falls below the level in the protected body.

The self-regulating tide gate generally comprises a door hingedly mounted to the conduit with its pivot axis at the top of the conduit. A door float is mounted to the lower edge of the door opposite the pivot axis of the door, and counterfloats are attached to counterfloat arms which are secured to the door and extend away from the door on the opposite side of its pivot axis.

When the water level is below the critical level, the door float assisted by the weight of the counterfloats and counterfloat arms maintain the lower edge of the door on the surface of the water, whereby reciprocal flow of water through the conduit is permitted. When the critical water level is achieved, the relatively large counterfloats begin to rise and overcome the buoyancy of the door float, thereby causing the door to pivot downwardly, whereby the door is caught in the water flow approaching the mouth of the conduit and forced closed against the mouth of the conduit. This prevents any further water flow through the gate/conduit system into the protected water body. The counterfloats are mounted to the counterfloat arms by links, the length of which is adjusted to achieve door closure at the desired critical water level.

The self-regulating tide gate also comprises a vacuum break comprising an air pipe intersecting the conduit adjacent the door, the air pipe admitting air to the conduit to "break" the vacuum otherwise formed adjacent the door immediately after the door closes. This greatly reduces the forces the door must withstand. The air pipe may extend upward from the conduit to an elevation above the critical water level and equal to or greater than the highest flood water level likely to occur in the open body of water. However, according to the invention herein, the vacuum break may comprise a relatively short air pipe which extends to above the critical water level and which is provided with a hinged lid and a rearwardly projecting counterweighted float. The counterweighted float maintains the lid in an open position until after the self-regulating tide gate door closes, and the counterweighted float closes the lid as the water level in the open body of water rises toward the open end of the air pipe. This seals the air pipe against admitting additional water into the conduit. When the water level falls below the top of the air pipe, the lid automatically opens by counterweight action. This vacuum break structure is shorter and more easily adapted to the conduit than a long air pipe.

As the water level in the open body of water recedes below that of the protected body of water, the hydraulic head in the conduit exceeds that of the water outside the door and pushes the door open, restoring full reciprocal water flow through the conduit. The door will continue to rise and fall with the fluctuating tide level until the next time the critical water level is reached.

Accordingly, a principal object of the invention herein is to provide a self-regulating tide gate which permits reciprocal water flow through a conduit connecting a protected body of water with an open body of water, automatically blocks the conduit upon attainment of a critical water level in the open body of water, and automatically reopens after the water level in the open body of water has receded below the critical level.

An additional object of the invention is to provide a self-regulating tide gate which is simple and reliable in its operation, and resists clogging by floating debris.

Another object of the invention is to provide a self-regulating tide gate with a more compact vacuum break.

A further object of the invention is to provide a self-regulating tide gate which is simple and economical to construct, install, inspect and maintain on existing or new conduit installations.

Another object of the invention is to provide a self-regulating tide gate which is easily adjustable to close at varying critical water levels.

Other and more specific objects and features of the invention will in part be obvious and will in part appear from the following description of the preferred embodiments and claims, taken together with the drawings.

DRAWINGS

The same reference numerals refer to the same elements throughout the various Figures.

DESCRIPTION OF PREFERRED EMBODIMENT

Figure 1:
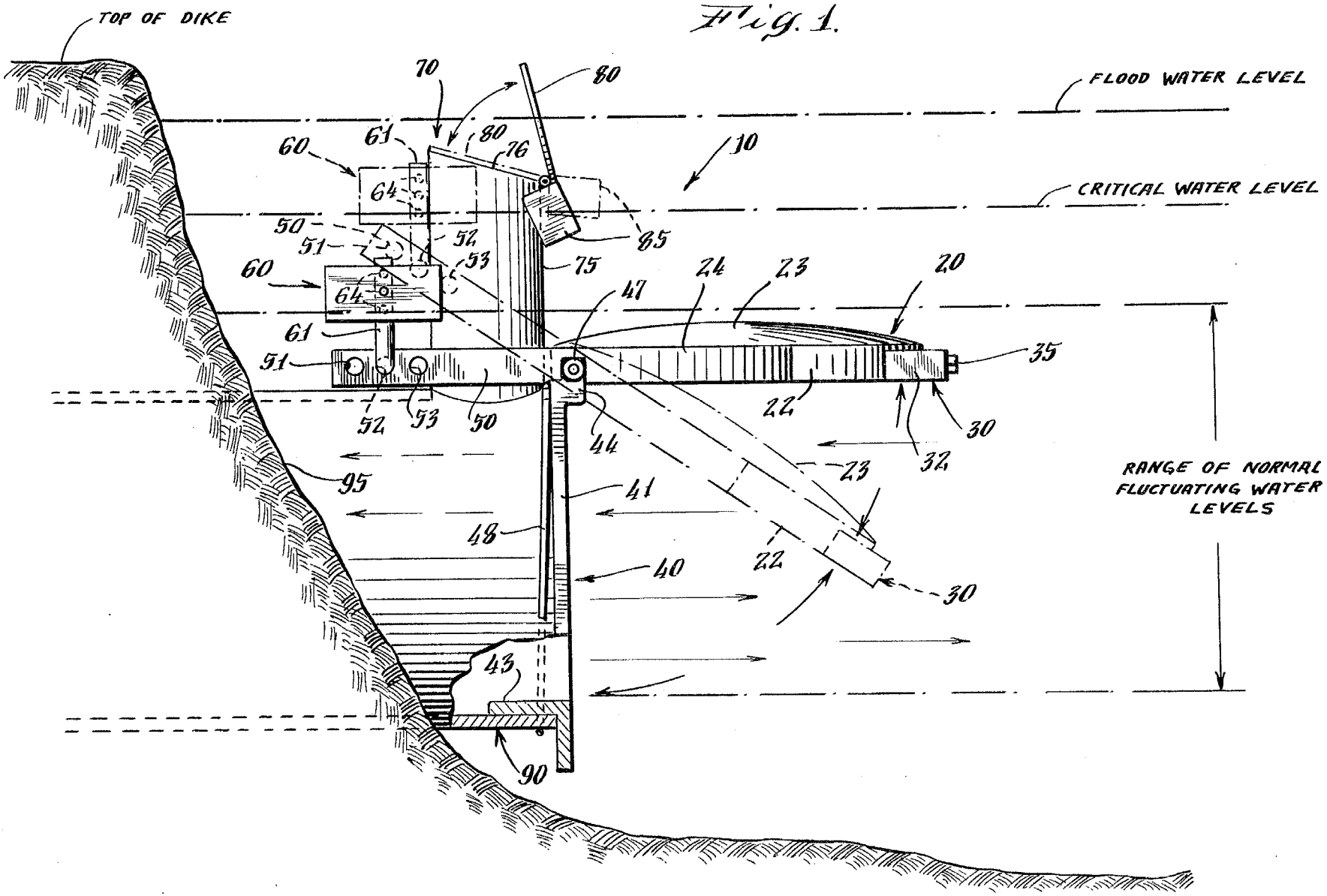
FIG. 1 is a side elevation view of a conduit installed in a dike separating a marsh and an ocean with an improved self-regulating tide gate and vacuum break according to the invention herein installed on the conduit, the self-regulating tide gate being in its open position.

Referring to FIGS. 1–6, an improved self-regulating tide gate 10 according to the invention herein is shown mounted to the end of a conduit 90 extending through an earthen dike 95. The self-regulating tide gate 10 generally comprises a door 20 having its upper edge pivotally mounted to the upper edge of the conduit 90 via a mounting plate 40, a door float 30 secured to the lower edge of the door 20, counterfloats 60 and 65 mounted to counterfloat arms 50 and 55, and a vacuum break 70. The self-regulating tide gate 10 is mounted to the conduit on the open water side of the dike 95 and permits reciprocal water flow through the conduit 90 between the open water side of the dike and the protected water side of the dike. However, when water on the open side of the dike reaches a critical level, i.e. a level at which continued flow of water through the conduit would cause flooding on the protected side of the dike, the self-regulating tide gate automatically closes to block the conduit. It reopens when the water level in the open water side of the dike recedes below the water level on the protected side of the dike.

Figure 3:
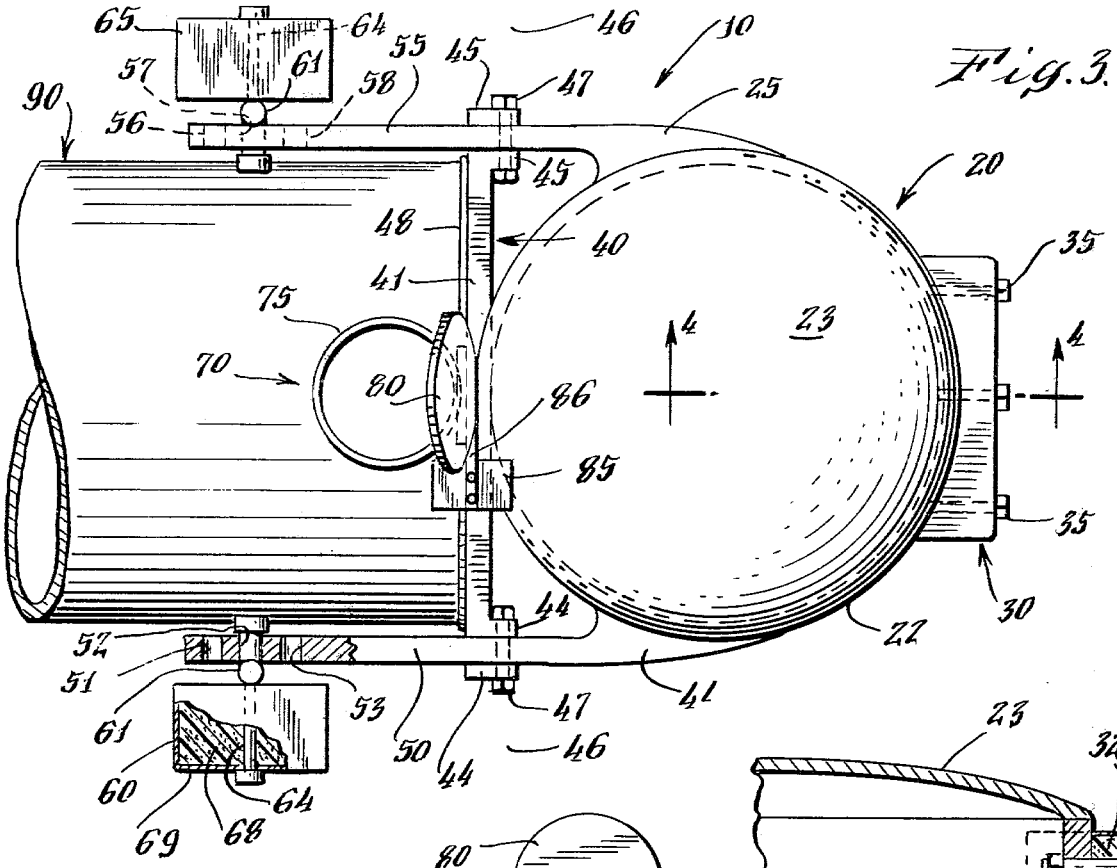
FIG. 3 is a top view of the self-regulating tide gate of FIG. 1.
Figure 2:
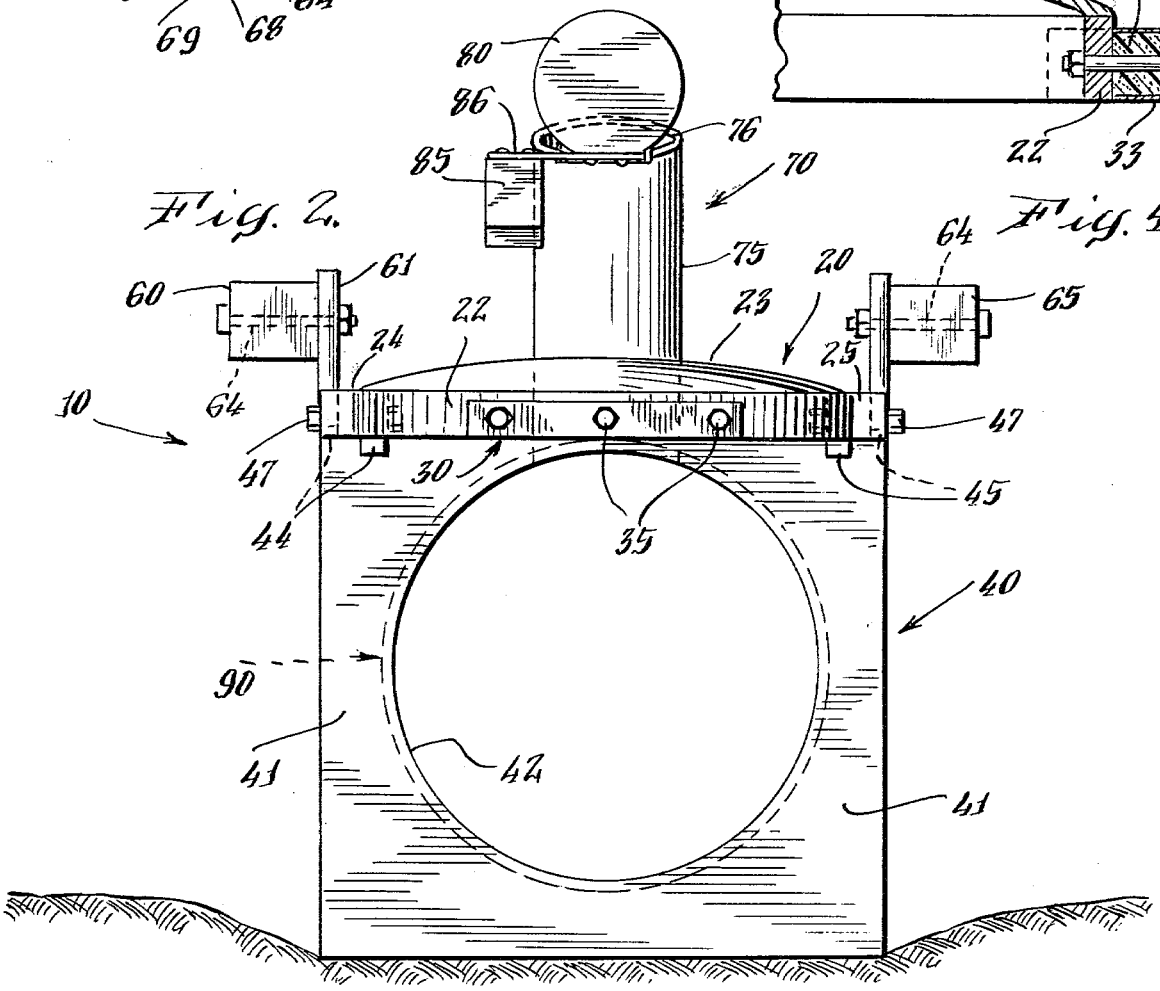
FIG. 2 is a front elevation view of the improved self-regulating tide gate of FIG. 1.

With particular reference to FIGS. 1–3, a mounting plate 40, which may be fabricated of metal, generally comprises a rectangular end plate 41 defining an opening 42 exposing the mouth of the conduit 90. A cylindrical sleeve 43 surrounds the opening 42 and extends from the end plate 41 into the end of the conduit 90 to facilitate securing the mounting plate 40 to the conduit 90. This may be accomplished by providing a cable 48 surrounding and clamping the conduit to the cylindrical sleeve 43, by bolting the conduit to the sleeve 43, by welding or by any other convenient method. Two pairs of hinge blocks 44 and 45 extend from the outer surface of the end plate 41 and define openings therethrough establishing a horizontal pivot axis 47 for the door 20, the pivot axis being generally at the top of the conduit 90, and more particularly, being spaced outwardly and upwardly from the top of the conduit to accommodate the thickness of the door per well-known hinging geometry.

Figure 4:
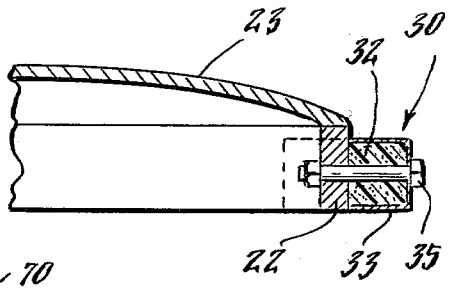
FIG. 4 is a sectional view of the door of the self-regulating tide gate taken along the lines 4—4 of FIG. 3.

The door 20 is sized to seat against the end plate 41 thereby covering the opening 42 in the mounting plate 40 and blocking the mouth of the conduit 90. The door 20 generally comprises a circular peripheral frame 22 having an inside diameter slightly larger than the opening 42 in the mounting plate 40. A circular door plate 23 fits over and has its peripheral edge secured to the peripheral frame 22. The door plate 23 is preferably domed outwardly with respect to the mouth of the conduit when the door 20 is in its closed position, as best seen in FIG. 4. The domed configuration provides for strength and water dispersal, as will be more fully explained below, and conical, parabolic, or other outwardly protruding configurations are also suitable. The door 20 further comprises a pair of mounting arms 24 and 25 secured to the peripheral frame 22 and providing for pivotally mounting the door 20 to the mounting plate 40. More particularly, the mounting arms 24 and 25 extend, respectively, between the pairs of hinge blocks 44 and 45 of the mounting plate 40 and define openings along the desired pivot axis of the door. Hinge pins in the form of bolts 47 are inserted through the openings in the hinge blocks and door mounting arms to mount the door 20 for pivotal movement between the closed position illustrated in FIG. 6, the partially opened position shown in FIG. 5 and the more fully opened position shown in FIGS. 2 and 3.

The mounting plate 40 may be fabricated of metal, and the door 20 may also be fabricated of metal, such as aluminum or a corrosion resistant steel alloy. However, other materials would also be suitable for the door, including wood, fiberglass, etc. The use of metal in fabricating the door is more important for the tide gates used on large diameter conduits, but lower cost wood doors can be used on smaller conduits if desired. It will also be appreciated that the door need not be circular, but merely that it be sized to block the mouth of the conduit. Therefore, a rectangular wooden door is suitable in small installations, with the pivot axis of the door again lying adjacent the upper edge of the conduit.

The door 20 has a door float 30 mounted thereto on the edge of the door opposite the pivot axis, i.e. the "lower" edge of the door when the door is in its closed position. The door float 30 is fabricated of a buoyant material, such as a closed-cell plastic foam 32, which is enclosed in a protective skin 33. The actual attachment of the float may be accomplished by machine screws, bolts or straps, as desired, and machine screws 35 extending through the float 30 into the peripheral frame 22 are illustrated in FIGS. 3 and 4.

The tide gate 10 further comprises at least one and preferably two counterfloat arms 50 and 55, which are secured to the door 20 and extend from the door 20 on the opposite side of the pivot axis 47. In the preferred embodiment illustrated, the counterfloat arms 50 and 55 comprise integral extensions of the door mounting arms 24 and 25, respectively. The counterfloat arm 50 defines a plurality of openings, e.g., openings 51–53 which are all spaced apart from the pivot axis of the door and are incrementally spaced apart from each other. The counterfloat arm 55 similarly defines openings 56–58.

Counterfloats 60 and 65, which may be fabricated of a closed-cell foam 68 covered by a plastic or metal skin 69, as best seen in FIG. 3, are respectively mounted to the counterfloat arms 50 and 55 via links 61 and 66. Link 61 is L-shaped and has its lower leg 62 pivotally mounted in a selected one of the openings 51–53 in counterfloat arm 50, and the counterfloat 60 is mounted in a selected one of openings 64 near the end of the upright leg 62 of the L-shaped link 61. The mounting of the counterfloat to the link may be pivotal, if desired. The counterfloat 65 is similarly mounted to the counterfloat arm 55 by an L-shaped link 66. As alternative structure, the links 61 and 66 may be chain or cable. The distance from the counterfloat arms at which the counterfloats are mounted and the selection of the openings in the counterfloat arms in which the lower legs of the links are mounted determine the critical water level at which the door 20 closes, as is more fully explained below in the discussion of the operation of the self-regulating tide gate 10.

A vacuum break 70 comprises an air pipe 75 mounted to and opening into the conduit 90 closely adjacent the mounting plate 40. The air pipe 75 extends from the conduit 90 to an open end 76 which is located above the critical water level at which the door 20 is set to close. The upper end 76 of the conduit 75 is preferably inclined as best seen in FIG. 1. A lid 80 is pivotally mounted to the lower edge of the mouth 76 of air pipe 75, whereby the lid 80 is pivotal between a closed position shown in dotted lines in FIG. 1 and an open position shown in the full lines in FIG. 1. A counterweighted float 85 is mounted to the lid 80 on the opposite side of the pivot axis thereof, and the counterweighted float 85 is preferably mounted on a rod 86 extending laterally from the lid 80 so that the float 85 clears the air pipe 75. The counterweight action of the float 85 pivots the lid 80 to its open position when the water level is below the float 85, and as the water level rises the float 85 is lifted and pivots the lid 80 to its closed position sealing off the mouth 76 of the air pipe 75. Alternatively, the air pipe 75 of the vacuum break 70 can extend to above the top of the dike 95, although this generally requires that a piling or the like be installed to support the air pipe 75.

With reference to FIG. 1, the two dotted lines 96 and 97 indicate the range of normal fluctuating water levels in the open body of water. It is desired that the self-regulating tide gate 10 permit reciprocal flow of water through the conduit 90 when the water level is in the normal range illustrated by the dotted lines 96 and 97. In the instance where the dike 95 separates a protected marsh land from an open body of salt water, the reciprocal flow of water preserves the tidal nature of the marsh lands with the benefits described above. Also illustrated in FIG. 1 is a critical water level shown by the dotted line 98. The critical water level is the water level at which continued flow of water from the open body of water through the conduit 90 would cause flooding in the protected body of water, and is therefore the water level at which the self-regulating tide gate 10 should close to prevent such further flow of water. A flood water level is illustrated by the dotted line 99, and if the water level of the protected body of water were permitted to equalize with the flood water level indicated by the dotted line 99, flooding would have occurred in the protected body of water.

Figure 5:
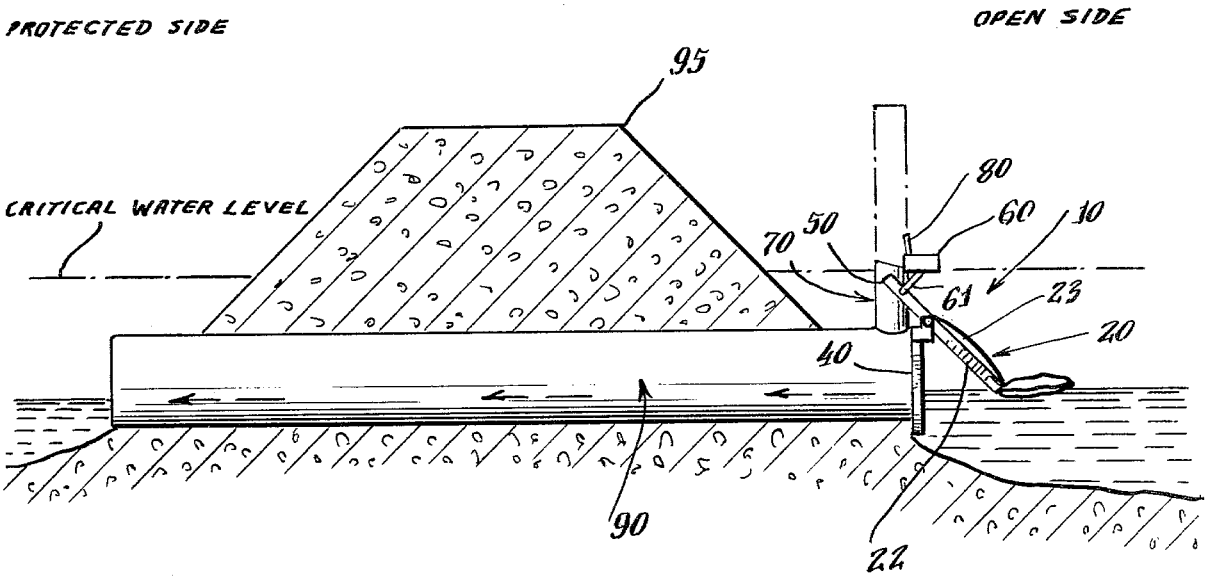
FIG. 5 is a side elevation view similar to FIG. 1 showing the improved self-regulating tide gate in a partially open position rising with the incoming water.

With reference to FIG. 5, when the water is in the lower portion of the normal range, the lower edge of the door 20 is supported on the surface of the water by the buoyant door float 30. This permits uninterrupted flow of water either into or out of the conduit 90 and has an added benefit in that the door and door float act to block floating debris from being drawn into the mouth of the conduit where it might become lodged and inhibit proper operation of the tide gate 10. During the low water operation of the door, the counterfloat arms 50 and 55 and the counterfloats 60 and 65 operate as counterweights which assist the door float 30 in maintaining the leading edge of the door on the surface of the water.

When the water rises to the upper end of the normal range, as indicated by the dotted water level line 97 in FIG. 1, the water acts on the counterfloats 60 and 65. The buoyant force exerted by the counterfloats 60 and 65 on the door 20 is greater than the buoyant force exerted by the door float 30 and any inherent buoyancy of the door itself (for instance if the door was made of wood), taking into account, of course, the distance the counterfloats 60 and 65 are separated from the pivot axis of the door as well as the distance that the door float 30 is separated from the pivot axis of the door. Thus, the counterfloats 60 and 65 begin to pivot the door 20 toward its closed position. This is illustrated by the full-line position of the door 20 in FIG. 1, wherein the leading edge of the door no longer tracks the surface of the water and the counterfloats have pivoted the door to a horizontal position. The door float 30 still holds the door open, permitting full flow of water through the conduit, and any floating debris is above the door.

Figure 6:
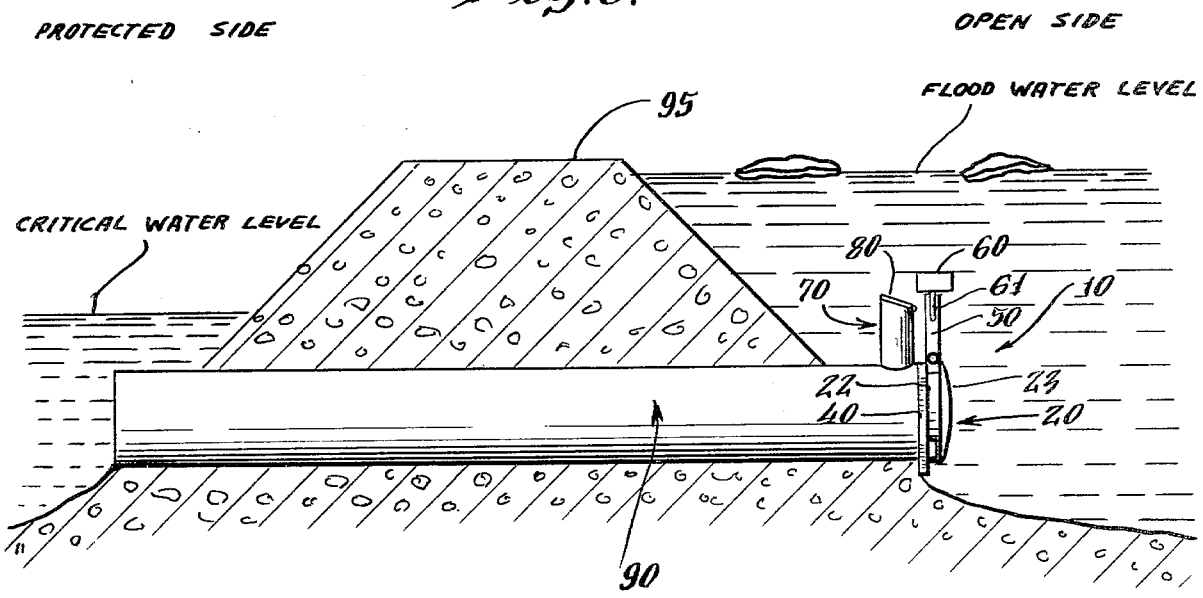
FIG. 6 is a side elevation view similar to FIG. 5 showing the improved self-regulating tide gate in its closed position.

Also with reference to FIG. 1, when the water level is at the critical water level illustrated by the dotted line 98, the counterfloats 60 and 65 have tipped the door 20 further toward its closed position, as shown by the dotted lines. At this point, the water flowing toward the mouth of the conduit 90 impinges upon the outer surface of the door 20, and the door 20 pivots to its closed position, seating against the mounting plate 40 as shown in FIG. 6. Once the door is "caught" in the incoming water flow, it closes quickly and remains in the closed position as the water level continues to rise. In this regard, it should be noted that the door float 30 is located substantially directly below the pivot axis of the door when the door is closed and, therefore, does not generate a great deal of force tending to open the door, and a hydrostatic pressure difference is developed across the door as the water level rises, which easily maintains the door in its closed position.

The vacuum break 70 operates to prevent damage to the self-regulating tide gate 10 and to the conduit 90 when the door closes. More particularly, when the door closes, there is a column of water moving through the conduit 90 away from the door, and as this column of water moves away from the door, it creates a low pressure area immediately adjacent the door. Absent the vacuum break 70, the low pressure area approaches or reaches a vacuum condition, which subjects the door to a large pressure differential that can damage the door. The vacuum break 70 alleviates this low pressure condition by permitting air to be drawn through the air pipe 75 and into the conduit 90 adjacent the door 20, destroying the vacuum which would otherwise be created in this area. Thus, the forces on the door are substantially less than they would be without provision of a vacuum break. Nevertheless, the atmospheric air pressure ducted to the area behind the door immediately after it closes is still less than water pressure on the outer surface of the door, whereby the door is subjected to some stress. It is for this reason that the door is preferably domed outwardly, thereby resisting the tendency of the pressure to bow the door inwardly and eventually destroy it. The domed configuration also has a less pronounced advantageous effect of dispersing the flow of water toward the door which occurs immediately after the door closes, during the transition from a flow condition through the conduit to a static condition.

If the water continues to rise to or above the flood water level indicated by the dotted line 99 in FIG. 1, the counterweighted float 85 is lifted and pivots the lid 80 closed thereby sealing off the mouth 76 of the vacuum break air pipe 75. This is, of course, necessary to prevent a flow of water to the protected body of water through the air pipe 75 and conduit 90. Alternatively, the air pipe 75 of the vacuum break 70 can extend to or above the top of the dike, whereby no water can flow to the protected body of water through the air pipe 75. As the water recedes from the flood level indicated by dotted line 99 toward the critical water level indicated by the dotted line 98, the water no longer acts on the counterweighted float 85, and the counterweighted float 85 operates to open the lid 80 preparatory to the next closing action of the door 20. The inclined angle of the lid 80 when closed upon the mouth 76 of air pipe 75 prevents debris, ice or the like from becoming lodged on the lid 80 and preventing it from opening.

When the water level in the open body of water has receded to below water level in the protected body of water, the hydrostatic pressures on the door 20 are reversed, the hydrostatic pressure generated by the water in the protected body becoming greater than that of the water in the open body. This causes the door to open to the position shown in the full lines of FIG. 1. As the water in the open body continues to recede, it no longer acts on the counterfloats 60 and 65, whereafter the leading edge of the door 20 is maintained on the surface of the water by the door float 80, assisted by the counterweight action of the counterfloats 60 and 65.

Thus, the self-regulating tide gate 10 permits the desired reciprocal flow of water through the conduit 90 so long as the water remains below the critical water level. However, the self-regulating tide gate 10 automatically closes when the critical water level is reached in the open body of water, and remains closed until the water level in the protected body of water recedes to below the water level in the open body of water. If the flow capacity of conduit 90 is sufficient, the critical water level at which the door closes will also be achieved in the protected body just prior to the door closing. It will be appreciated that the door does not necessarily reopen at the critical water level, since rain and runoff could raise the water level in the protected body while the door is closed. However, the door will open as soon as the water level in the open body is lower than that in the protected body, providing drainage as soon as drainage is possible.

The critical water level at which the self-regulating tide gate closes may be adjusted, the adjustments being achieved by adjusting the length of the L-shaped links 61 and also by selecting which of the openings in the counterfloat arms 50 and 55 are selected for mounting the links 61. In this regard, a quicker closing action is achieved when the counterfloats 60 and 65 are positioned closer to the pivot axis of the door, since the door is tipped into the current more rapidly for an incremental rise in water level.

Thus, the tide gate 10 described above admirably achieves the objects of the invention herein.

It is advantageous over prior self-regulating water control valves in simplicity of structure and in operation. Because the door "tracks" the surface of the water at lower water levels, there is no need to have the door "set" itself in an open position, and the mouth of the conduit is protected against the possibility of debris jamming therein. Both of these features contribute to reliable operation. It will be appreciated that various changes may be made in the embodiment shown, which is illustrative only, without departing from the spirit and scope of the invention, which is limited only by the following claims.

I claim:

1. A self-regulating tide gate for installation on a conduit connecting an open body of water with a protected body of water wherein it is desired to permit reciprocal flow of water through the conduit until the water level in the open body of water reaches a critical level after which continued water flow through the conduit would undesirably elevate the level of water in the protected body of water, the self-regulating tide gate comprising:

(A) a door having its upper edge pivotally mounted about a pivot axis at the top of the conduit, the door being pivotable to a closed position blocking the flow of water into the conduit;

(B) a buoyant door float mounted to the edge of the door opposite the pivot axis of the door;

(C) at least one counterfloat arm secured to the door and extending across the pivot axis of the door; and (D) at least one buoyant counterfloat attached to the counterfloat arm at a point spaced apart from the pivot axis of the door, wherein the lower edge of the door is maintained on or near the surface of the water, preventing floating debris from becoming jammed in the conduit, until the water rises to a level where it acts on the buoyant counterfloat to pivot the door into the flow of water entering the conduit, the flow of water acting to close the door, and the door reopens when the water level in the open body of water recedes below the water level in the protected body of water.

2. A self-regulating tide gate as defined in claim 1 and further comprising:

(E) a vacuum break including an air pipe intersecting the conduit connecting the two bodies of water adjacent the door pivotally mounted thereto, the air pipe extending from the conduit to above the dike, whereby when the door closes the vacuum break permits air to enter the conduit immediately adjacent the closed door but prevents water from entering the conduit through the air pipe.

3. A self-regulating tide gate as defined in claim 1 and further comprising:

(E) a vacuum break including, (1) an air pipe intersecting the conduit connecting the two bodies of water adjacent the door pivotally mounted thereto, the air pipe extending from the conduit to the air above the critical water level at which the door closes, whereby when the door closes the vacuum break permits air to enter the conduit immediately adjacent the closed door, and (2) a float operated lid pivotally mounted to the open end of the air pipe and a counterweight float mounted to the lid across the pivot axis of the lid, whereby the counterweight action of the counterweighted float maintains the lid in an open position when the water level is below the open end of the air pipe and the float action of the counterweighted float pivots the lid to a closed position blocking the open end of the air pipe after the door closes and before the water level rises to the open end of the air pipe.

4. A self-regulating tide gate as defined in claim 3 wherein the open end of the air pipe is inclined and the lid is also inclined when closed on the open end of the air pipe, whereby the lid sheds debris which might otherwise block it from opening.

5. A self-regulating tide gate as defined in claim 1 and further comprising:

(E) a mounting plate secured to the open end of the conduit and defining an opening into the conduit, wherein the door is pivotally mounted to the mounting plate and pivotal to a closed position blocking the opening into the conduit defined by the mounting plate.

6. A self-regulating tide gate as defined in claim 5 wherein the door has an outwardly protruding configuration providing strength against collapsing into the conduit upon closing and dispersing water flow toward the door immediately after it closes.

7. A self-regulating tide gate as defined in claim 6 wherein the door has a circular peripheral frame and a domed circular door plate having its edges secured to the frame, and a pair of door arms extending from the frame and pivotally mounted to the mounting plate.

8. A self-regulating tide gate as defined in claim 7 wherein the at least one counterfloat arm comprises two counterfloat arms which are integral extensions of the door arms across the pivot axis of the door, and the at least one counterfloat comprises two counterfloats respectively mounted to the two counterfloat arms.

9. A self-regulating tide gate as defined in claim 8 wherein each counterfloat is mounted to its counterfloat arm by a link and the length of the link between the counterfloat and counterfloat arm is selected to close the door at the desired critical level.

10. A self-regulating tide gate as defined in claim 9 wherein the links are L-shaped, each having one leg pivotally mounted to its counterfloat arm and the other leg mounting the counterfloat spaced apart from the counterfloat arm.

11. A self-regulating tide gate as defined in claim 10 wherein the counterfloat arms each define a plurality of openings spaced apart from the pivot axis of the door and from each other, and the link is mounted in a selected one of the openings, whereby when the link is mounted in an opening closer to the pivot axis of the door the counterfloat provides quicker closing action of the door by tipping it more quickly into the flow of water entering the conduit.

12. A self-regulating tide gate as defined in claim 11 and further comprising:

(E) a vacuum break including an air pipe intersecting the conduit connecting the two bodies of water adjacent the door pivotally mounted thereto, the air pipe extending from the conduit to above the dike, whereby when the door closes the vacuum break permits air to enter the conduit immediately adjacent the closed door but prevents water from entering the conduit through the air pipe.

13. A self-regulating tide gate as defined in claim 11 and further comprising:

(E) a vacuum break including, (1) an air pipe intersecting the conduit connecting the two bodies of water adjacent the door pivotally mounted thereto, the air pipe extending from the conduit to the air above the critical water level at which the door closes, whereby when the door closes the vacuum break permits air to enter the conduit immediately adjacent the closed door, and (2) a float operated lid pivotally mounted to the open end of the air pipe and a counterweight float mounted to the lid across the pivot axis of the lid, whereby the counterweight action of the counterweighted float maintains the lid in an open position when the water level is below the open end of the air pipe and the float action of the counterweighted float pivots the lid to a closed position blocking the open end of the air pipe after the door closes and before the water level rises to the open end of the air pipe.

14. A self-regulating tide gate as defined in claim 1 wherein the at least one counterfloat arm comprises two counterfloat arms which are integral extensions of the door extending across the pivot axis of the door, and the at least one counterfloat comprises two counterfloats respectively mounted to the two counterfloat arms.

15. A self-regulating tide gate as defined in claim 14 wherein each counterfloat is mounted to its counterfloat arm by a link and the length of the link between the counterfloat and counterfloat arm is selected to close the door at the desired critical level.

16. A self-regulating tide gate as defined in claim 15 wherein the counterfloat arms each define a plurality of mounting points for the links spaced apart from the pivot axis of the door and from each other, and the link is mounted at a selected one of the mounting points, whereby when the link is mounted at a mounting point closer to the pivot axis of the door the counterfloat provides quicker closing action of the door by tipping it more quickly into the flow of water entering the conduit.

17. An improvement in water control valves of the type comprising a door pivotally mounted to the input end of a generally horizontal conduit leading out of a body of water, the door being held in an open position permitting flow through the water conduit and freely pivotal to a closed position blocking flow through the water conduit, wherein when there exists a full and swift flow through the water conduit and the door is closed, the freely pivotal transition of the door from its open to its closed position is rapid and a column of water continues to move through the water conduit after the water is closed, thereby drawing a vacuum behind the door and subjecting the door to a large and potentially damaging pressure differential, the improvement comprising a vacuum break including, (A) an air pipe intersecting the conduit connecting the two bodies of water adjacent the door pivotally mounted thereto, the air pipe extending from the conduit to the air above the critical water level at which the door closes, whereby when the door closes the vacuum break permits air to enter the conduit immediately adjacent the closed door, and (B) a float operated lid pivotally mounted to the open end of the air pipe and a counterweight float mounted to the lid across the pivot axis of the lid, whereby the counterweight action of the counterweighted float maintains the lid in an open position when the water level is below the open end of the air pipe and the float action of the counterweighted float pivots the lid to a closed position blocking the open end of the air pipe after the door closes and before the water level rises to the open end of the air pipe.

18. A self-regulating tide gate as defined in claim 17 wherein the open end of the air pipe is inclined and the lid is also inclined when closed on the open end of the air pipe, whereby the lid sheds debris which might otherwise block it from opening.

* * * * *